US011378359B2

(12) United States Patent
Lyons

(10) Patent No.: US 11,378,359 B2
(45) Date of Patent: Jul. 5, 2022

(54) ARMOR SYSTEMS WITH PRESSURE WAVE REDIRECTION TECHNOLOGY

(71) Applicant: TenCate Advanced Armor USA, Inc., Goleta, CA (US)

(72) Inventor: Fielder Stanton Lyons, Phoenix, AZ (US)

(73) Assignee: TenCate Advanced Armor USA, Inc., Goleta, CA (US)

( * ) Notice: Subject to any disclaimer, the term of this patent is extended or adjusted under 35 U.S.C. 154(b) by 96 days.

(21) Appl. No.: 16/886,492

(22) Filed: May 28, 2020

(65) Prior Publication Data

US 2021/0372740 A1 Dec. 2, 2021

(51) Int. Cl.
*F41H 5/04* (2006.01)

(52) U.S. Cl.
CPC ..... *F41H 5/04* (2013.01); *F41H 5/0428* (2013.01); *F41H 5/0457* (2013.01)

(58) Field of Classification Search
None
See application file for complete search history.

(56) References Cited

U.S. PATENT DOCUMENTS 3,559,210 A 2/1971 Hansen
4,584,228 A 4/1986 Droste
5,349,893 A 9/1994 Dunn
5,465,424 A * 11/1995 Cudney ..... A41D 13/0158 2/92
5,534,343 A 7/1996 Landi et al.
5,918,309 A 7/1999 Bachner, Jr.
6,253,655 B1 7/2001 Lyons
6,341,708 B1 1/2002 Palley et al.
6,418,832 B1 7/2002 Colvin
6,627,562 B1 9/2003 Gehring, Jr.
6,846,545 B2 1/2005 Thomas
7,100,216 B2 9/2006 Matechen et al.
7,540,228 B1 6/2009 Cronin et al.
7,601,654 B2 10/2009 Bhatnagar et al.
D638,583 S 5/2011 Bishop
8,071,206 B1 * 12/2011 Chang ..... E04H 9/10 428/304.4

(Continued)

FOREIGN PATENT DOCUMENTS

BR 102016029577 A1 3/2017
JP 2019072859 A 5/2019

(Continued)

OTHER PUBLICATIONS

International Patent Application No. PCT/US2020/034975, International Search Report and Written Opinion, dated Feb. 2, 2021.

*Primary Examiner* — Reginald S Tillman, Jr.
(74) *Attorney, Agent, or Firm* — Kilpatrick Townsend & Stockton LLP

(57) ABSTRACT

An armor system or plate designed to reduce the extent of back face deformation by re-directing the pressure wave created by a projectile impact. More specifically, armor systems according to embodiments of the invention are provided with redirection channels whereby the pressure or shock waves generated by projectile impact are guided or spread laterally along the channels and out of the plate so as to reduce back face deformation and consequent impact to the wearer.

17 Claims, 3 Drawing Sheets

(56) References Cited

U.S. PATENT DOCUMENTS

| | | | | |
|---|---|---|---|---|
| 8,096,223 | B1 | 1/2012 | Andrews | |
| 8,348,656 | B1 | 1/2013 | Gintz et al. | |
| 8,375,839 | B2 | 2/2013 | Landi | |
| 8,490,213 | B2 | 7/2013 | Neal | |
| 8,522,664 | B2 | 9/2013 | Chen et al. | |
| 8,596,183 | B2 | 12/2013 | Coltrane | |
| 8,927,088 | B2 | 1/2015 | Faden et al. | |
| 9,091,509 | B2 | 7/2015 | Gettle et al. | |
| 9,291,440 | B2 | 3/2016 | Ardiff et al. | |
| 9,335,129 | B1 | 5/2016 | Perciballi | |
| 10,151,565 | B2 | 12/2018 | Fonte et al. | |
| 10,274,289 | B1 | 4/2019 | Barnhart, II | |
| 10,414,921 | B1 | 9/2019 | Dehni | |
| 2004/0118271 | A1 | 6/2004 | Puckett et al. | |
| 2008/0011153 | A1 | 1/2008 | MacDonald | |
| 2009/0136702 | A1 | 5/2009 | Gu | |
| 2009/0282595 | A1 | 11/2009 | Branson et al. | |
| 2010/0307327 | A1* | 12/2010 | Gettle | F41H 5/0442 89/36.02 |
| 2011/0113951 | A1 | 5/2011 | Daley et al. | |
| 2012/0234164 | A1 | 9/2012 | Kucherov et al. | |
| 2015/0300438 | A1* | 10/2015 | Elgy | B60R 21/04 188/377 |
| 2019/0025015 | A1 | 1/2019 | Davis et al. | |

FOREIGN PATENT DOCUMENTS

| | | | | |
|---|---|---|---|---|
| WO | 2000055567 | A1 | 9/2000 | |
| WO | 2005045351 | A1 | 5/2005 | |
| WO | WO-2007001433 | A2 * | 1/2007 | F41H 1/02 |

* cited by examiner

ARMOR SYSTEMS WITH PRESSURE WAVE REDIRECTION TECHNOLOGY

FIELD

Embodiments of the present invention relate to protective armor systems having improved resistance to back face deformation.

BACKGROUND

Armor systems can be used to protect the wearer (i.e., person or object) against projectiles (e.g., bullets, metal fragments, etc.) and other objects moving at high velocities. For example, armor systems can be used in body armor (e.g., bulletproof vests) and can be provided on vehicles such as various types of land vehicles, ships, and aircraft. The armor systems are sized and shaped to provide protection as desired. By way only of example, a body armor system worn can be sized and built to protect the wearer's vital areas/organs from the most likely directions of attack (e.g., the front and back of the wearer).

The protection afforded by armor systems may be tailored depending on the anticipated impacts to which it will be subjected. Some armor systems ("soft armor system") can be formed entirely of fabrics made from high-strength, bullet-resistant materials (e.g., Kevlar, nylon, etc.). Other armor systems ("hard armor system") include a rigid component, such as a metal plate (steel, aluminum, titanium, etc.) or a ceramic plate (aluminum oxide ($Al_2O_3$), silicon carbide (SiC), boron carbide ($B_4C$), SiC/$B_4C$ blends, titanium diboride, etc.) or a composite layer of laminated fiber-reinforced plastics, such as, but not limited to, fiberglass reinforced plastics, aramid reinforced plastics, ultra-high molecular weight polyethylene, polypropylene, combinations thereof, or other suitable materials. All armor system designs involve a balance of weight and protection level to develop a system that is suitable to a particular environment and anticipated threat.

Common to all armor systems is the need that they (i) stop the fast-moving projectile (prevent the projectile from perforating the armor) and (ii) have limited rear deformation (referred to as Back Face Deformation (BFD)) so as not to further injure the wearer, or damage the object that the armor system is protecting. When an projectile impacts the front face of the armor, the back face of the armor proximate the wearer can deform. BFD results from the armor retarding progression, and absorbing the energy, of the projectile. More specifically, when a high speed projectile impacts the armor, a pressure or shock wave is generated and propagates through the armor, typically outwardly from the point of impact (i.e., towards the back of the armor and the body of the wearer). The pressure wave can deform the armor itself but also continue beyond the armor to directly impact the wearer. Thus, both the deformed or deflected armor as well as the pressure wave can contribute to blunt force trauma to the wearer.

There is a need for an armor system that can effectively stop the projectile but also reduce the extent of back face deformation, even with armor systems having thinner profiles.

SUMMARY

Embodiments of the present invention are directed to an armor system (also referred to herein as armor plates) designed to reduce the extent of back face deformation by re-directing the pressure wave created by a projectile impact. More specifically, armor systems according to embodiments of the invention are provided with redirection channels whereby the pressure or shock wave generated by projectile impact, which would normally propagate rearwardly toward the wearer, is guided or spread laterally along the channels and out of the plate so as to reduce BFD and impact to the wearer.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described herein with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to an armor system (also referred to herein as armor plates) designed to reduce the extent of back face deformation by re-directing the pressure wave created by a projectile impact. More specifically, armor systems according to embodiments of the invention are provided with redirection channels whereby the pressure or shock wave generated by projectile impact, which would normally propagate rearwardly toward the wearer, is guided or spread laterally along the channels and out of the plate so as to reduce BFD and impact to the wearer.

Figure 1:
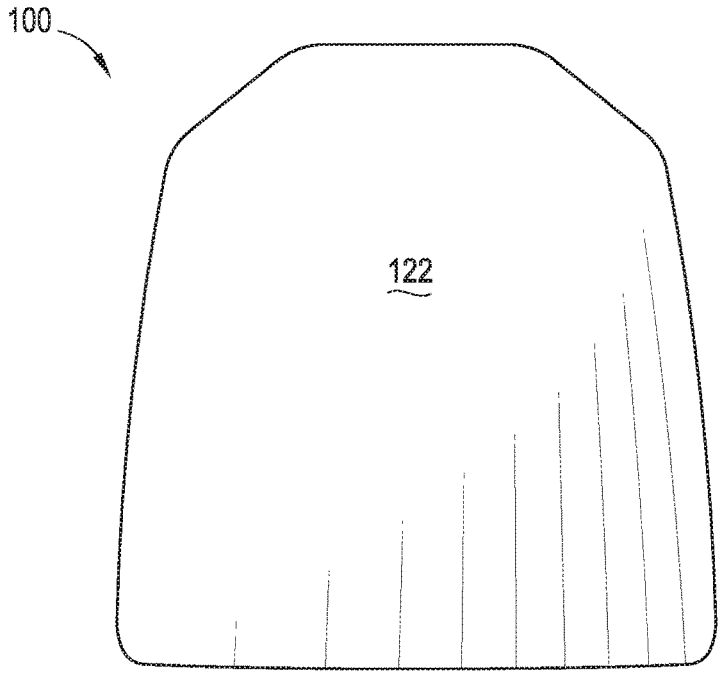
FIG. 1 is a front elevation view of an armor system according to embodiments of the disclosure.
Figure 2:
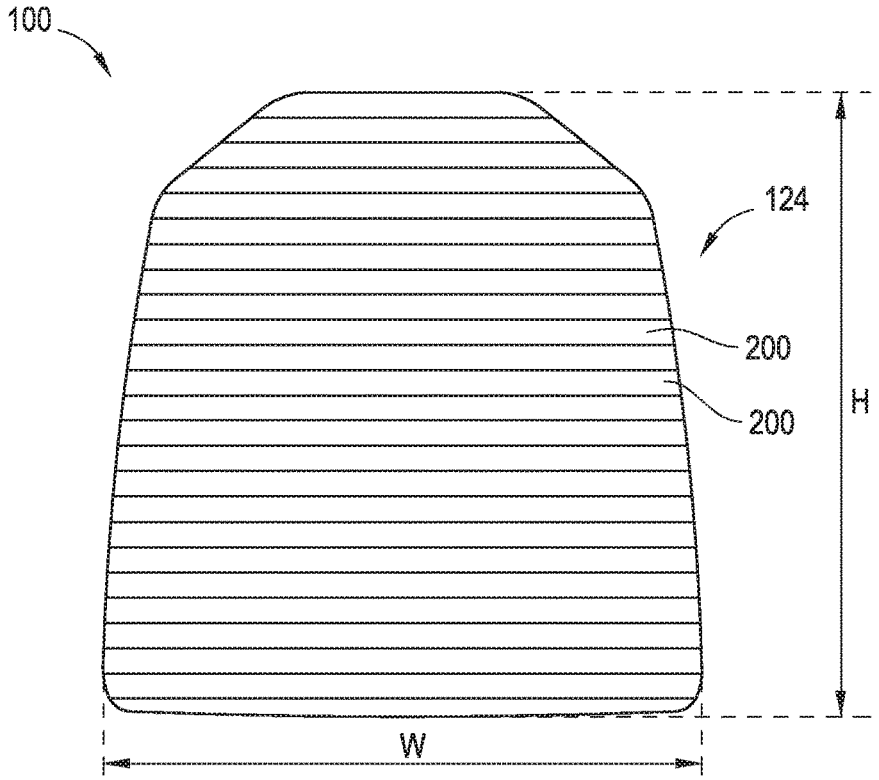
FIG. 2 is a rear elevation view of the armor system of FIG. 1.
Figure 3:
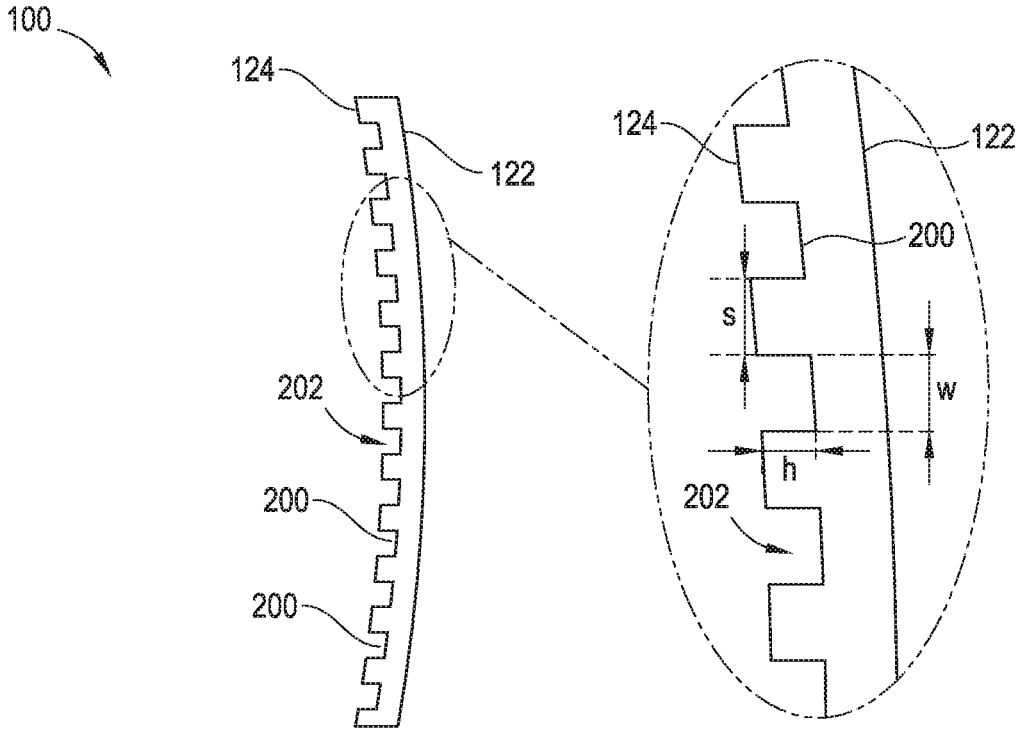
FIG. 3 is a side elevation view of the armor system of FIG. 1, with an enlarged inset portion.
Figure 4:
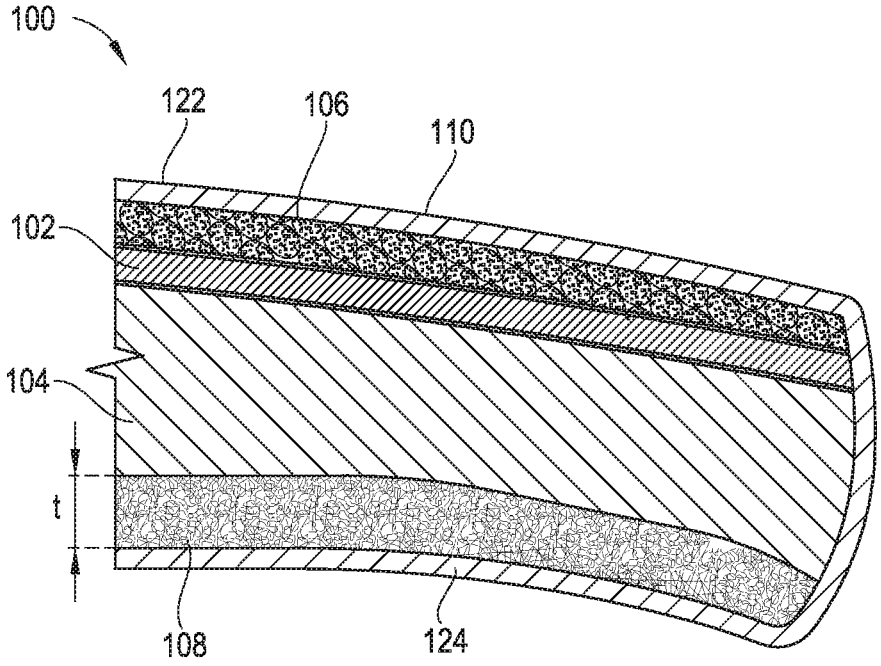
FIG. 4 is a sectional view of a portion of the armor system of FIG. 1.
Figure 5:
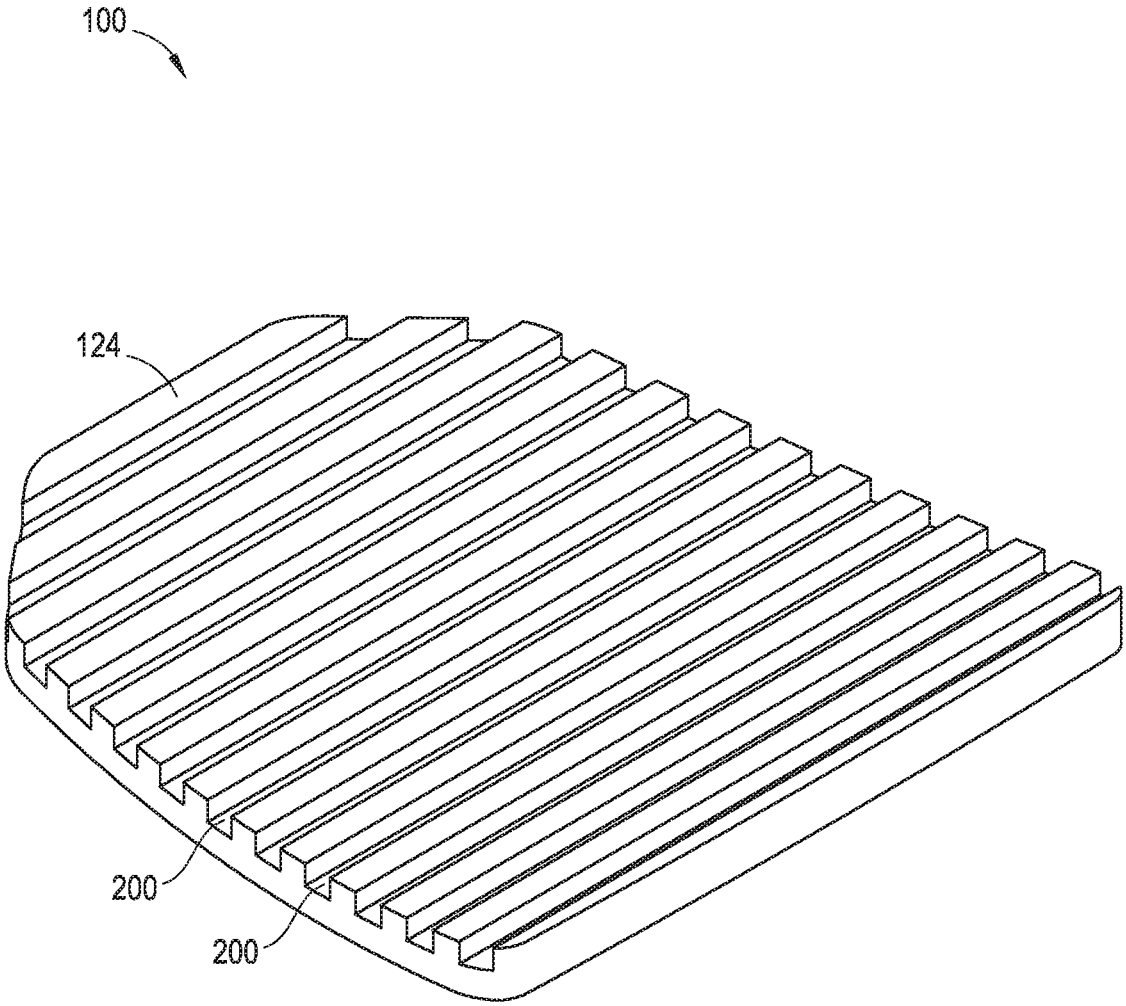
FIG. 5 is a rear perspective view of the armor system of FIG. 1.

Such redirection channels are provided along the rear face of the armor plate and can be incorporated into any hard armor system. By way only of example, FIGS. 1-5 illustrates an armor system or plate 100 that includes a strike face protection layer 106, a first rigid component 102, a second rigid component 104, and a body side protection layer 108, all of which are encased in an armor covering 110.

The first rigid component 102 may be made from a metallic or ceramic material. The second rigid component 104 may be a composite layer of laminated fiber-reinforced plastics, such as, but not limited to, fiberglass reinforced plastics, aramid reinforced plastics, ultra-high molecular weight polyethylene, polypropylene, combinations thereof, or other suitable fabrics or materials. While the embodiment of FIGS. 1-5 includes two rigid ballistic components, embodiments of the invention may include only a single rigid ballistic layer (i.e., either 102 or 104) or may include additional rigid ballistic layers.

In certain embodiments, the strike face protection layer 106 is proximate the front face 122 of the armor system 100 and thus may provide protection against blunt impacts (e.g., dropping the armor plate or falling while wearing the armor plate). In some examples, the strike face protection layer 106 is a foam, although other suitable materials may be utilized. The body side protection layer 108 may be provided to further reduce BFD during the projectile impact and provide additional protection to the user. In some cases, the body side protection layer 108 is a foam, although other suitable materials may be utilized, such as, but not limited to, 3D woven fabrics or molded plastic. The armor covering 110 may form an outermost layer of the armor system 100 and protects the armor system 100 from the environment, such as moisture and fluids that could compromise the integrity of the bonds between the armor system components. The armor covering 110 may be formed from various suitable materials including, but not limited to, various fabrics, such as nylon, or polyurea coatings, although other suitable materials may be utilized.

In some embodiments of the present invention, redirection channels 200 are formed in the body side protection layer 108 so as to extend along the back face 124 of the armor system 100 such that channel openings 202 are exposed along the back face 124 of the plate. In some embodiments, the body side protection layer 108 is a foam layer and the redirection channels 200 are provided in the foam layer such that, when the armor system 100 is encapsulated in the armor covering 110, the channels 200 extend along the back face 124 of the armor system 100. While redirection channels 200 with exposed openings 202 are illustrated, it is possible that the redirection channels 200 may be enclosed within the body side protection layer 108 such that no openings are provided along the back face 124. Alternatively, the width w of the channel 200 can vary (i.e., taper or narrow) along its height h (measured from the lowest point or base of the channel 200) such that the width w of the channel 200 (and thus the channel opening 202) distal the rigid component 102 is narrower than the width w of the channel 200 more proximate the rigid component 102. Narrower channel openings 202 (or none at all) help to restrict movement of the pressure wave rearwardly out of the channels (and towards the wearer). Still further, the width w of the channel 200 can vary along its height h (i.e., widen) such that the width w of the channel 200 (and thus the channel opening 202) distal the rigid component 102 is greater than the width w of the channel 200 more proximate the rigid component 102. The redirection channels 200 can have any cross-sectional shape, including, but not limited to, rectangular, square, v-shaped, curved, round, etc.

In some embodiments, the redirection channels 200 are continuous straight channels that extend across the entire dimension of the back face 124 without interruption so as to create continuous paths for the pressure wave to propagate. In this way, the pressure wave is re-directed outwardly from the armor plate (i.e., substantially parallel to the back face 124 and plane of the wearer) so as to reduce the extent of back face deformation and the risk of injury to the wearer. In other embodiments, one or more of the redirection channels 200 may be discontinuous across the dimension of the back face 124. In some embodiments, the channels 200 extend substantially parallel to the width W of the armor plate 100 at the back face 124 and substantially perpendicular to the height H of the armor plate 100 at the back face 124. However, the channels 200 may be oriented in other directions and/or at other angles along the back face 124. In some embodiments, the channels 200 all extend parallel to each other, but in other embodiments one or more channels 200 may extend at an angle relative to other channels 200.

The redirection channels 200 disclosed herein may be provided in body side protection layers 108 formed of any material. However, inclusion of redirection channels 200 have been found particularly suitable in hard armor systems that include a body side protection layer 108 formed of foam. In such cases, discrete foam pieces may be attached to the forwardly adjacent layer in the armor system 100 (in the embodiment shown in FIG. 4, the second rigid component 104) such that the channels 200 are formed between the foam pieces. In other embodiments, the body side protection layer 108 is an integral component into which the desired channels are molded, grooved, tunneled, or otherwise formed.

Any number of redirection channels 200 may be provided. The redirection channels 200 may be provided along the entire height H of the armor plate 100 or along only a portion of the height H of the armor plate 100. The spacings between adjacent redirection channels 200 can be consistent or different. In some embodiments, the spacing s between adjacent redirection channels 200 is between 0.10-2.0 inches, inclusive; 0.15-1.5 inches, inclusive; 0.20-1.25 inches, inclusive; 0.25-1.0 inches, inclusive; 0.10-0.75 inches, inclusive; 0.20-0.50 inches, inclusive. In some embodiments, the width w and/or height h of at least some of the channels 200 is substantially the same as the thickness t of the foam body side protection layer 108, but this is not a requirement. Rather, in some embodiments, the width w and/or height h of at least some of the channels 200 is at least 25%; at least 50%; at least 75%; or at least 100% of the thickness t of the foam layer 108. In some embodiments, the width w and/or height h of at least some of the channels 200 is between 10-25% (inclusive) the thickness t of the foam layer; between 25%-50% (inclusive) the thickness t of the foam layer; between 50%-75% (inclusive) the thickness t of the foam layer; and/or between 75%-100% (inclusive) the thickness t of the foam layer. In some embodiments, the back face 124 has an area defined by the width W and height H of the armor plate 100 at the back face 124 and the channels 200 (with channel openings 202) constitute between 20-80%, inclusive, of the area of the back face 124; between 30-70%, inclusive, of the area of the back face 124; and/or between 40-60%, inclusive, of the area of the back face 124.

In some embodiments, the channels 200 (with channel openings 202) constitute approximately 50% of the area of the back face 124.

While FIGS. 1-5 illustrate an armor system 100 formed of a plurality of different layers, redirection channels 200 may be provided on any hard armor system, including those that are more simplistic or more complex than that shown in the figures. For example, such a system might not include a strike face protection layer 106 and/or may include only a single rigid layer (102 or 104). Alternatively, the armor system may include more components than shown in the figures.

The measure of the extent to which the back face deforms (i.e., the extent of BFD) is referred to as back face signature (BFS). It has been found that when redirection channels 200 are provided in the foam layer, the extent of BFD is reduced. Furthermore, most body side foam layers used in hard armor systems have a thickness t of between 0.12 to 0.50 inches, inclusive. It has been found that the extent of BFD can be maintained (i.e., does not worsen) when thinner foam layers (on the order of half the standard thickness t) provided with redirection channels 200 are used. To demonstrate these discoveries, the back face signature of four armor plates was tested and measured pursuant to NIJ 0101.06*: Ballistic Resistance of Body Armor* (2008 edition, the entirety of which is incorporated herein by reference).

Embodiments of the armor plates disclosed herein may be suitable for different types of armor systems, including, but not limited to, Type III and Type IV armor systems set forth in NIJ 0101.06. To test the back face signature of a Type III armor plate in accordance with NIJ 0101.06, the plate is strapped onto, so as to be in direct contact with, a deformable clay backing panel. The plate is struck with a 7.62×51-mm M80 ball projectile at muzzle velocity. The impact of the projectile creates a depression in the clay, which is referred to as the back face signature. The depth of that depression is measured in millimeters and represents the BFS depth. NIJ 0101.06 requires a BFS depth of no greater than 44 millimeters. Note that the NIJ 0101.06 test method for a Type IV armor plate is identical to that for a Type III armor plate with the exception of the type of projectile used during testing and the number of shots taken on each armor plate.

The four armor plates tested were identical in that they were 9.5 inch×12.5 inch plates formed of a rigid component and a foam backing layer. The rigid component was an ultra-high molecular weight polyethylene fiber based composite laminate available from Dyneema® under the trade name HB212. The foam layer was adhered to the rigid component, and the composite was encased in a polyurea coating. The only difference between the four armor plates was the foam layer. The differences between the foam layers are identified in Table 1:

TABLE 1

| Armor Plate (AP) | Foam Thickness (inches) | Channels in foam? | Channel Height (inches) | Channel Width (inches) | Spacing Between Adjacent Channels |
|---|---|---|---|---|---|
| AP1 (prior art) | 0.50 | No | N/A | N/A | N/A |
| AP2 | 0.50 | Yes | 0.13 | 0.13 | 0.25 |
| AP3 | 0.25 | Yes | 0.25 | 0.25 | 0.25 |
| AP4 | 0.25 | No | N/A | N/A | N/A |

The channels in both AP2 and AP3 extended horizontally across the width W of the plates (i.e., orthogonal to the height H of the plates).

Each of AP1 to AP4 was tested in accordance with the protocols set forth in NIJ 0101.06 for Type III armor. It should be noted, however, that embodiments of the present invention would also be applicable to reducing the BFS depth on NIJ 0101.06 for Type IV armor.

Three separate plate samples of AP1 and AP2 were submitted for testing, seven plate samples of AP3 were submitted for testing, and six plate samples of AP4 were submitted for testing. Each plate sample was shot twice. Hence, there are a total of six BFS depth measurements for each of AP1 and AP2, fourteen BFS depth measurements for AP3, and twelve BFS depth measurements for AP4. Table 2 reflects the results of this testing.

TABLE 2

| Shot # | AP1 | AP2 | AP3 | AP4 |
|---|---|---|---|---|
| | BFS Depth (mm) | | | |
| 1 | 34.47 (plate #1) | 36.97 (plate #1) | 39.4 (plate #1) | 41.17 (plate #1) |
| 2 | 39.17 (plate #1) | 37.28 (plate #1) | 41.73 (plate #1) | 45.82 (plate #1) |
| 3 | 37.64 (plate #2) | 39.42 (plate #2) | 41.04 (plate #2) | 42.31 (plate #2) |
| 4 | 46.12 (plate #2) | 40.94 (plate #2) | 38.76 (plate #2) | 44.68 (plate #2) |
| 5 | 37.35 (plate #3) | 33.4 (plate #3) | 36.87 (plate #3) | 43.63 (plate #3) |
| 6 | 44.03 (plate #3) | 42.6 (plate #3) | 43.25 (plate #3) | 47.34 (plate #3) |
| 7 | — | — | 35.59 (plate #4) | 37.73 (plate #4) |
| 8 | — | — | 37.84 (plate #4) | 36.36 (plate #4) |
| 9 | — | — | 34.68 (plate #5) | 37.48 (plate #5) |
| 10 | — | — | 40.11 (plate #5) | 41.6 (plate #5) |
| 11 | — | — | 38.74 (plate #6) | 42.21 (plate #6) |
| 12 | — | — | 38.00 (plate #6) | 41.81 (plate #6) |
| 13 | — | — | 41.23 (plate #7) | — |
| 14 | — | — | 42.71 (plate #7) | — |
| Average BFS Depth | 39.80 | 38.44 | 39.28 | 41.85 |
| Standard Deviation | 4.41 | 3.27 | 2.57 | 3.36 |
| Plate # | Overall Plate Weight (lbs.) | | | |
| 1 | 2.43 | 2.49 | 2.53 | 2.32 |
| 2 | 2.34 | 2.4 | 2.58 | 2.29 |
| 3 | 2.47 | 2.26 | 2.54 | 2.31 |
| 4 | — | — | 2.35 | 2.34 |
| 5 | — | — | 2.33 | 2.34 |
| 6 | — | — | 2.32 | 2.35 |
| 7 | — | — | 2.28 | — |
| Average Weight | 2.41 | 2.38 | 2.42 | 2.33 |
| Plate # | Overall Plate Thickness (in.) | | | |
| 1 | 1.099 | 1.104 | 0.889 | 0.857 |
| 2 | 1.062 | 1.086 | 0.897 | 0.898 |
| 3 | 1.111 | 1.051 | 0.897 | 0.917 |
| 4 | — | — | 0.897 | 0.854 |
| 5 | — | — | 0.85 | 0.91 |
| 6 | — | — | 0.841 | 0.90 |
| 7 | — | — | 0.847 | — |
| Average Thickness | 1.09 | 1.08 | 0.87 | 0.89 |

It is noteworthy that all of the BFS depth measurements for the armor plates provided with channels (AP2 and AP3)

were below 44 mm. This was not the case for AP1 and AP4, which were devoid of redirection channels. Moreover, comparing the performance of plates having foam layers of the same thickness such that the provision of channels was the only differentiating feature, it can be seen that AP2 (0.50 inch foam layer with channels) resulted in a lower average BFS depth than AP1 (0.50 inch foam layer without channels). Similarly, the average BFS depth of AP3 (0.25 inch foam layer with channels) was markedly lower than that of AP4 (0.25 inch foam layer without channels), representing a statistically significant difference at a 95% confidence (pursuant to a t-test comparison). Thus, inclusion of channels unquestionably reduced the BFS of the armor plates. Moreover, the standard deviation of the average BFS depth of AP3 was almost 25% less than that of AP4, indicating a higher repeatability (i.e., more consistent) product design.

Furthermore, it was also discovered that thinner foam layers provided with channels can perform as well as thicker foam layers. For example, despite having a foam layer that was half as thick, AP3 (0.25 inch foam layer with channels) slightly outperformed AP1 (0.50 inch foam layer without channels) with respect to average BFS depth. This demonstrates that thinner and lighter armor systems may be used while maintaining—indeed, possibly even improving—the level of protection to the wearer.

While redirection channels 200 may be incorporated into any type of armor system, they are particularly suitable for use with armor systems for protection of the body (e.g. torso). In embodiments where the armor system is to be worn, the armor system can be inserted into a garment (e.g., vest) designed to accommodate the armor system. Moreover, while the armor system is illustrated as a substantially planar plate in the Figures, the armor system may have various shapes or profiles depending on desired use. For example, the armor system may be sized and shaped to contour to the object it will protect. It should be noted too that embodiments of the present invention, while suitable for use as "stand-alone" armor systems, may also be incorporated into "in-conjunction" armor systems whereby the hard armor plates disclosed herein are used in conjunction with a soft armor system. Finally, while the plates disclosed herein have been demonstrated compliant with the BFS standards of NIJ 0101.06, such plates also comply with comparable standards and requirements, such as those set forth in the United Kingdom's *Home Office Body Armour Standard* 2017, the entirety of which is incorporated herein by reference.

EXAMPLES

A collection of examples, including at least some explicitly enumerated as "Examples" providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Example 1. An armor plate having a front face, a back face, a width, and a height, the armor plate comprising: a rigid layer; and a foam layer attached to the rigid layer, wherein a plurality of redirection channels are provided in the foam layer so as to extend continuously across the width of the armor plate, wherein the rigid layer is more proximate the front face of the armor plate than the back face and the foam layer is more proximate the back face of the armor plate than the front face.

Example 2. The armor plate of any preceding or subsequent example or combinations of examples, further comprising a polymeric coating that encapsulates the rigid layer and the foam layer.

Example 3. The armor plate of any preceding or subsequent example or combinations of examples, wherein the rigid layer comprises a metal or ceramic plate.

Example 4. The armor plate of any preceding or subsequent example or combinations of examples, wherein the plurality of redirection channels are provided and extend along the back face of the armor plate.

Example 5. The armor plate of any preceding or subsequent example or combinations of examples, wherein the plurality of redirection channels extend parallel across the width of the armor plate.

Example 6. The armor plate of any preceding or subsequent example or combinations of examples, wherein the plurality of redirection channels extend across the width of the armor plate orthogonal to the height of the armor plate.

Example 7. The armor plate of any preceding or subsequent example or combinations of examples, wherein at least some of the plurality of redirection channels have a channel height and a channel width that is consistent along the channel height.

Example 8. The armor plate of any preceding or subsequent example or combinations of examples, wherein at least some of the plurality of channels have a channel height and a channel width that decreases along the channel height in a direction towards the back face of the armor plate.

Example 9. The armor plate of any preceding or subsequent example or combinations of examples, wherein a spacing between adjacent channels of the plurality of redirection channels is between 0.10 inches and 0.75 inches, inclusive.

Example 10. The armor plate of any preceding or subsequent example or combinations of examples, wherein the foam layer comprises a foam thickness and wherein at least some of the plurality of redirection channels comprise a height that is at least 50% the foam thickness.

Example 11. The armor plate of any preceding or subsequent example or combinations of examples, wherein the at least some of the plurality of redirection channels comprise a height that is approximately equal to the foam thickness.

Example 12. The armor plate of any preceding or subsequent example or combinations of examples, wherein the back face of the armor plate comprises an area and wherein the plurality of redirection channels constitute between 30-70%, inclusive, of the area of the back face.

Example 13. The armor plate of any preceding or subsequent example or combinations of examples, wherein the armor plate comprises a back face signature depth of 44 millimeters or less when tested in accordance with at least one of NIJ 0101.06, Type III armor (2008 edition) or NIJ 0101.06, Type IV armor (2008 edition).

Example 14. The armor plate of any preceding or subsequent example or combinations of examples, wherein the foam layer comprises a thickness and wherein, when the armor plate is tested in accordance with at least one of NIJ 0101.06, Type III armor (2008 edition) or NIJ 0101.06, Type IV armor (2008 edition), the armor plate comprises a back face signature depth that is equal to or less than a back face signature depth of a control armor plate identical to the armor plate except that the foam layer of the control armor plate is (i) devoid of redirection channels and (ii) is thicker than the foam layer of the armor plate.

Example 15. The armor plate of any preceding or subsequent example or combinations of examples, wherein, when the armor plate is tested in accordance with at least one of NIJ 0101.06, Type III armor (2008 edition) or NIJ 0101.06, Type IV armor (2008 edition), the armor plate comprises a back face signature depth that is less than a back face signature depth of a control armor plate identical to the armor plate except that the foam layer of the control armor plate is devoid of redirection channels.

Example 16. An armor plate having a front face, a back face, a width, and a height, the armor plate comprising: a rigid layer; a foam layer attached to the rigid layer and comprising a foam thickness; a plurality of parallel redirection channels provided within the foam layer so as to extend continuously along the back face of the armor plate and across the width of the armor plate orthogonal to the height of the armor plate, wherein a spacing between adjacent channels of the plurality of redirection channels is between 0.10 inches and 0.75 inches, inclusive, and wherein at least some of the plurality of redirection channels comprise a height that is at least 50% the foam thickness; and a polymeric coating that encapsulates the rigid layer and the foam layer, wherein the armor plate comprises a back face signature depth of 44 millimeters or less when tested was tested in accordance with at least one of NIJ 0101.06, Type III armor (2008 edition) or NIJ 0101.06, Type IV armor (2008 edition).

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

I claim:

1. An armor plate having a front face, a back face, a width, and a height, the armor plate adapted to protect a body of a wearer and be worn such that the back face is more proximate the body than the front face, the armor plate comprising:

a. a rigid layer; and b. a foam layer attached to the rigid layer, wherein a plurality of redirection channels are provided in the foam layer so as to extend continuously across the width of the armor plate, wherein the rigid layer is more proximate the front face of the armor plate than the back face and the foam layer is more proximate the back face of the armor plate than the front face, and wherein the armor plate comprises a back face signature depth of 44 millimeters or less when tested in accordance with at least one of NIJ 0101.06, Type III armor (2008 edition) or NIJ 0101.06, Type IV armor (2008 edition).

2. The armor plate of claim 1, further comprising a polymeric coating that encapsulates the rigid layer and the foam layer.

3. The armor plate of claim 1, wherein the rigid layer comprises a metal or ceramic plate.

4. The armor plate of claim 1, wherein the plurality of redirection channels are provided and extend along the back face of the armor plate.

5. The armor plate of claim 1, wherein the plurality of redirection channels extend parallel across the width of the armor plate.

6. The armor plate of claim 5, wherein the plurality of redirection channels extend across the width of the armor plate orthogonal to the height of the armor plate.

7. The armor plate of claim 1, wherein at least some of the plurality of redirection channels have a channel height and a channel width that is consistent along the channel height.

8. The armor plate of claim 1, wherein at least some of the plurality of channels have a channel height and a channel width that decreases along the channel height in a direction towards the back face of the armor plate.

9. The armor plate of claim 1, wherein a spacing between adjacent channels of the plurality of redirection channels is between 0.10 inches and 0.75 inches, inclusive.

10. The armor plate of claim 1, wherein the foam layer comprises a foam thickness and wherein at least some of the plurality of redirection channels comprise a height that is at least 50% the foam thickness.

11. The armor plate of claim 10, wherein the at least some of the plurality of redirection channels comprise a height that is approximately equal to the foam thickness.

12. The armor plate of claim 1, wherein the back face of the armor plate comprises an area and wherein the plurality of redirection channels constitute between 30-70%, inclusive, of the area of the back face.

13. The armor plate of claim 1, wherein the foam layer comprises a thickness and wherein, when the armor plate is tested in accordance with at least one of NIJ 0101.06, Type III armor (2008 edition) or NIJ 0101.06, Type IV armor (2008 edition), the back face signature depth of the armor plate is equal to or less than a back face signature depth of a control armor plate identical to the armor plate except that the foam layer of the control armor plate is (i) devoid of redirection channels and (ii) is thicker than the foam layer of the armor plate.

14. The armor plate of claim 1, wherein, when the armor plate is tested in accordance with at least one of NIJ 0101.06, Type III armor (2008 edition) or NIJ 0101.06, Type IV armor (2008 edition), the back face signature depth of the armor plate is less than a back face signature depth of a control armor plate identical to the armor plate except that the foam layer of the control armor plate is devoid of redirection channels.

15. An armor plate having a front face, a back face, a width, and a height, the armor plate comprising:

a. a rigid layer;

b. a foam layer attached to the rigid layer and comprising a foam thickness;

c. a plurality of parallel redirection channels provided within the foam layer so as to extend continuously along the back face of the armor plate and across the width of the armor plate orthogonal to the height of the armor plate, wherein a spacing between adjacent channels of the plurality of redirection channels is between 0.10 inches and 0.75 inches, inclusive, and wherein at least some of the plurality of redirection channels comprise a height that is at least 50% the foam thickness; and d. a polymeric coating that encapsulates the rigid layer and the foam layer, wherein the armor plate comprises a back face signature depth of 44 millimeters or less when tested was tested in accordance with at least one of NIJ 0101.06, Type III armor (2008 edition) or NIJ 0101.06, Type IV armor (2008 edition).

16. An armor plate having a front face, a back face, a width, and a height, the armor plate adapted to protect a body of a wearer and be worn such that the back face is more proximate the body than the front face, the armor plate comprising:

a. a rigid layer; and b. a foam layer attached to the rigid layer, wherein a plurality of redirection channels are provided in the foam layer so as to extend continuously across the width of the armor plate, wherein the rigid layer is more proximate the front face of the armor plate than the back face and the foam layer is more proximate the back face of the armor plate than the front face, and wherein the foam layer comprises a thickness and wherein, when the armor plate is tested in accordance with at least one of NIJ 0101.06, Type III armor (2008 edition) or NIJ 0101.06, Type IV armor (2008 edition), the armor plate comprises a back face signature depth that is equal to or less than a back face signature depth of a control armor plate identical to the armor plate except that the foam layer of the control armor plate is (i) devoid of redirection channels and (ii) is thicker than the foam layer of the armor plate.

17. An armor plate having a front face, a back face, a width, and a height, the armor plate adapted to protect a body of a wearer and be worn such that the back face is more proximate the body than the front face, the armor plate comprising:

a. a rigid layer; and b. a foam layer attached to the rigid layer, wherein a plurality of redirection channels are provided in the foam layer so as to extend continuously across the width of the armor plate, wherein the rigid layer is more proximate the front face of the armor plate than the back face and the foam layer is more proximate the back face of the armor plate than the front face, and wherein, when the armor plate is tested in accordance with at least one of NIJ 0101.06, Type III armor (2008 edition) or NIJ 0101.06, Type IV armor (2008 edition), the armor plate comprises a back face signature depth that is less than a back face signature depth of a control armor plate identical to the armor plate except that the foam layer of the control armor plate is devoid of redirection channels.

* * * * *